US007066814B2

(12) United States Patent
Glavich et al.

(10) Patent No.: US 7,066,814 B2
(45) Date of Patent: Jun. 27, 2006

(54) GAMING DEVICE HAVING REGENERATING MULTIPLE AWARD OPPORTUNITIES

(75) Inventors: Paulina Glavich, Reno, NV (US); Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 76 days.

(21) Appl. No.: 09/960,784

(22) Filed: Sep. 21, 2001

(65) Prior Publication Data

US 2003/0060272 A1 Mar. 27, 2003

(51) Int. Cl.
*A63F 9/24* (2006.01)

(52) U.S. Cl. ..... 463/20; 463/16

(58) Field of Classification Search ..... 463/1, 463/20–25, 40–42; 273/143 R
See application file for complete search history.

(56) References Cited

U.S. PATENT DOCUMENTS

| | | | |
|---|---|---|---|
| 4,624,459 | A | 11/1986 | Kaufman |
| 4,669,731 | A | 6/1987 | Clarke |
| 4,695,053 | A | 9/1987 | Vazquez, Jr. et al. |
| 5,205,555 | A | 4/1993 | Hamano |
| 5,393,057 | A | 2/1995 | Marnell, II |
| 5,407,200 | A | 4/1995 | Zalabak |
| 5,423,539 | A | 6/1995 | Nagao |
| 5,449,173 | A | 9/1995 | Thomas et al. |
| 5,456,465 | A | 10/1995 | Durham |
| 5,560,603 | A | 10/1996 | Seelig et al. |
| 5,647,798 | A | 7/1997 | Falciglia |
| 5,711,525 | A | 1/1998 | Breeding |
| 5,722,891 | A | 3/1998 | Inoue |
| 5,772,506 | A | 6/1998 | Marks et al. |
| 5,779,544 | A | 7/1998 | Seelig et al. |
| 5,788,573 | A | 8/1998 | Baerlocher et al. |
| 5,807,172 | A | 9/1998 | Piechowiak |
| 5,823,874 | A | 10/1998 | Adams |
| 5,848,932 | A | 12/1998 | Adams |
| 5,851,148 | A | 12/1998 | Brune et al. |
| 5,855,514 | A | 1/1999 | Kamille |
| 5,882,261 | A | 3/1999 | Adams |
| 5,911,418 | A | 6/1999 | Adams |
| 5,918,880 | A | 7/1999 | Voigt, IV et al. |
| 5,919,088 | A | 7/1999 | Weiss |
| 5,935,002 | A | 8/1999 | Falciglia |
| 5,947,820 | A | 9/1999 | Morro et al. |
| 5,964,463 | A | 10/1999 | Moore, Jr. |

(Continued)

FOREIGN PATENT DOCUMENTS

EP 0 874 337 A1 10/1998

(Continued)

OTHER PUBLICATIONS

Spin Til You Win Game Description written by IGT, published in 1996.

(Continued)

*Primary Examiner*—Julie Brocketti
(74) *Attorney, Agent, or Firm*—Bell, Boyd & Lloyd LLC

(57) ABSTRACT

The present invention involves an apparatus and method for regenerating or awarding extra chances or opportunities to a player in connection with a gaming device and preferably in a bonus round of a gaming device. The present invention contemplates regenerating or awarding a plurality of extra chances or opportunities upon the occurrence of a predetermined event. More specifically, the present invention contemplates regenerating or awarding a number of extra chances or opportunities equal to the number of chances or opportunities with which the player enters or begins the game or bonus round of the present invention.

56 Claims, 7 Drawing Sheets

U.S. PATENT DOCUMENTS 5,971,849 A 10/1999 Falciglia
5,980,384 A 11/1999 Barrie
5,988,638 A 11/1999 Rodesch et al.
6,003,867 A 12/1999 Rodesch et al.
6,004,207 A 12/1999 Wilson, Jr. et al.
6,012,982 A 1/2000 Piechowiak et al.
6,015,346 A 1/2000 Bennett
6,056,642 A 5/2000 Bennett
6,059,289 A * 5/2000 Vancura ..... 273/143 R
6,059,658 A 5/2000 Mangano et al.
6,062,980 A 5/2000 Luciano
6,089,976 A 7/2000 Schneider et al.
6,089,977 A 7/2000 Bennett
6,089,978 A 7/2000 Adams
6,102,400 A 8/2000 Scott et al.
6,102,798 A 8/2000 Bennett
6,113,098 A 9/2000 Adams
6,120,378 A 9/2000 Moody et al.
6,126,542 A 10/2000 Fier
6,142,873 A 11/2000 Weiss et al.
6,142,874 A 11/2000 Kodachi et al.
6,155,925 A 12/2000 Giobbi et al.
6,159,095 A 12/2000 Frohm et al.
6,159,097 A 12/2000 Gura
6,159,098 A 12/2000 Slomiany et al.
6,162,121 A 12/2000 Morro et al.
6,168,520 B1 1/2001 Baerlocher et al.
6,168,523 B1 1/2001 Piechowiak et al.
6,173,955 B1 1/2001 Perrie et al.
6,174,233 B1 1/2001 Sunaga et al.
6,186,894 B1 2/2001 Mayeroff
6,190,254 B1 2/2001 Bennett
6,190,255 B1 2/2001 Thomas et al.
6,203,429 B1 3/2001 Demar et al.
6,220,959 B1 4/2001 Holmes, Jr. et al.
6,224,482 B1 5/2001 Bennett
6,224,483 B1 * 5/2001 Mayeroff ..... 463/20
6,227,971 B1 5/2001 Weiss
6,231,442 B1 5/2001 Mayeroff
6,231,445 B1 5/2001 Acres
6,234,879 B1 5/2001 Hasegawa et al.
6,234,897 B1 5/2001 Frohm et al.
6,251,013 B1 6/2001 Bennett
6,261,128 B1 7/2001 Heim et al.
6,261,177 B1 7/2001 Bennett
6,270,409 B1 8/2001 Shuster
6,270,411 B1 8/2001 Gura et al.
6,299,165 B1 10/2001 Nagano
6,302,790 B1 10/2001 Brossard
6,305,686 B1 10/2001 Perrie et al.
6,309,300 B1 10/2001 Glavich
6,311,976 B1 11/2001 Yoseloff et al.
6,312,334 B1 11/2001 Yoseloff
6,315,660 B1 11/2001 DeMar et al.
6,315,663 B1 11/2001 Sakamoto
6,328,649 B1 12/2001 Randall et al.
6,334,864 B1 1/2002 Amplatz et al.
6,340,158 B1 1/2002 Pierce et al.
6,347,996 B1 2/2002 Gilmore et al.
6,364,768 B1 4/2002 Acres et al.
6,394,902 B1 5/2002 Glavich et al.
6,398,644 B1 6/2002 Perrie et al.
6,443,452 B1 9/2002 Brune
6,471,208 B1 10/2002 Yoseloff et al.
6,481,713 B1 11/2002 Perrie et al.
6,491,584 B1 * 12/2002 Graham et al. ..... 463/25
6,537,150 B1 3/2003 Luciano et al.
6,537,152 B1 3/2003 Seelig et al.
6,561,904 B1 5/2003 Locke et al.
6,565,436 B1 5/2003 Baerlocher
6,604,740 B1 8/2003 Singer et al.
6,705,944 B1 * 3/2004 Luciano ..... 463/20
6,733,389 B1 5/2004 Webb et al.
6,855,052 B1 * 2/2005 Weiss et al. ..... 463/16
6,869,360 B1 3/2005 Marks et al.
2001/0009865 A1 7/2001 Demar et al.
2002/0010017 A1 * 1/2002 Bennett ..... 463/20

FOREIGN PATENT DOCUMENTS

EP 0 981 119 A2 2/2000
EP 1 513 117 A2 3/2005
GB 2 322 217 A 8/1998
WO WO 00/32286 6/2000
WO WO 01/26019 A1 4/2001

OTHER PUBLICATIONS

Dolphin Treasure Advertisement written by Aristocrat Leisure Industries Pty., Ltd., published in 1996.
Jackpot Party Brochures and Articles written by WMS Gaming, Inc., published in 1998.
Double Diamond Run Advertisement written by IGT, published date not known.
Catch A Wave Advertisement written by IGT, published in 2001.
Catch A Wave Advertisement written by IGT, published in Dec. 2000.

* cited by examiner

GAMING DEVICE HAVING REGENERATING MULTIPLE AWARD OPPORTUNITIES

CROSS REFERENCE TO RELATED APPLICATIONS

This application relates to the following co-pending commonly owned patent applications: "GAMING DEVICE HAVING APPARATUS AND METHOD FOR PRODUCING AN AWARD THROUGH AWARD ELIMINATION OR REPLACEMENT," Ser. No. 09/686,283; "GAMING DEVICE HAVING AN AWARD EXCHANGE BONUS ROUND AND METHOD FOR REVEALING AWARD EXCHANGE POSSIBILITIES," Ser. No. 09/689,510; "GAMING DEVICE HAVING A MULTI-ROUND BONUS SCHEME WHEREIN EACH ROUND HAS A PROBABILITY OF SUCCESS," Ser. No. 09/688,441; "GAMING DEVICE HAVING GRADUATING AWARD EXCHANGE SEQUENCE WITH A TEASE CONSOLATION SEQUENCE AND AN INITIAL QUALIFYING SEQUENCE," Ser. No. 09/680,601; "GAMING DEVICE HAVING RELATED MULTI-GAME BONUS SCHEME," Ser. No. 09/688,972; "GAMING DEVICE HAVING A RE-TRIGGER SYMBOL BONUS SCHEME," Ser. No. 09/981,133, now U.S. Pat. No. 6,913,532; "GAMING DEVICE HAVING IMPROVED OFFER AND ACCEPTANCE BONUS SCHEME," Ser. No. 09/680,630; "GAMING DEVICE HAVING FREE GAMES BONUS WITH A CHANGING MULTIPLIER," Ser. No. 10/086,146; 'GAMING DEVICE HAVING A BONUS GAME WITH MULTIPLE PLAYER SELECTABLE AWARD OPPORTUNITIES," Ser. No. 10/237,207; "GAMING DEVICE HAVING A RE-TRIGGERING SYMBOL BONUS SCHEME WITH A BONUS SYMBOL ACCUMULATOR," Ser. No. 10/071,441; "GAMING DEVICE INCLUDING A GAME HAVING PLAYER SELECTED FUNCTION BASED ON SYMBOLS IN A FREE SPINS GAME," Ser. No. 10/243,052; "GAMING DEVICE HAVING A PROBABILITY ENHANCING TRIGGER SYMBOL," Ser. No. 10/241,255; "GAMING DEVICE INCLUDING A GAME HAVING A WILD SYMBOL RELATED AWARD," Ser. No. 10/633,391; "GAMING DEVICE HAVING A PROBABILITY-ENHANCING TRIGGER SYMBOL," Ser. No. 10/661,443; "GAMING DEVICE HAVING A BONUS GAME WITH MULTIPLE PLAYER SELECTABLE AWARD OPPORTUNITIES," Ser. No. 10/660,076; "GAMING DEVICE HAVING A FREE SPIN GAME," Ser. No. 10/953,812; "GAMING DEVICE HAVING SEQUENTIAL ACTIVATIONS OF A GAME AND REPLAY OF PREVIOUS ACTIVATIONS OF THE GAME," Ser. No. 10/956,508; "GAMING DEVICE WITH CHANGING WILD SYMBOLS," Ser. No. 10/956,303; "GAMING DEVICE HAVING FREE SPIN MODE WITH SYMBOL ELIMINATION," Ser. No. 10/953,818; "GAMING DEVICE HAVING A RE-TRIGGERING SYMBOL BONUS SCHEME WITH A BONUS SYMBOL ACCUMULATOR AND PLAYER SELECTION OF ACCUMULATION TOTAL," Ser. No. 10/952,656; and "GAMING DEVICE HAVING A RE-TRIGGER SYMBOL BONUS SCHEME," Ser. No. 11/156,112.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device that regenerates or retriggers multiple award opportunities on a physical or mechanical display device.

BACKGROUND OF THE INVENTION

The base or primary game of most slot machines involves one or more mechanical or video spinning reels, each of which display a plurality of symbols. In many games, a symbol or combination of symbols yield one or more opportunities or chances in a bonus or secondary game, which is played in addition to the base game. In some instances, when the player uses one of the chances, the bonus game provides an award to the player and enables the player to have an extra opportunity or chance. Examples of this type of game include the "Spin till You Win", "Queen of the Nile" and "Jackpot Party" games.

Known games provide a single retry or a single extra award generation opportunity. These games provide the player a limited benefit. Gaming device manufacturers constantly strive to develop more exciting and more entertaining games. One method, described below, for providing a more exciting and entertaining game is to provide a regeneration or retriggering device that enables the player to obtain multiple retries or multiple extra award generation opportunities.

SUMMARY OF THE INVENTION

The present invention provides an apparatus and method for regenerating or awarding extra chances or opportunities to a player in connection with a gaming device and preferably in a bonus round of a gaming device. The present invention contemplates regenerating or awarding a plurality of extra chances or opportunities upon the occurrence of a predetermined event. More specifically, the present invention contemplates regenerating or awarding a number of extra chances or opportunities equal to or based on the random number of chances or opportunities with which the player enters or begins the game or bonus round.

In one preferred embodiment, the player plays the base game of a slot machine by spinning one or more reels, each of which display a plurality of symbols. If the player generates a first predetermined symbol or symbol combination, the game provides a first predetermined number of chances in the bonus round. If the player generates a second predetermined symbol or symbol combination, the game provides a second predetermined number of chances in the bonus round, and so on. It should be appreciated that base games typically display symbols, such as video poker where the cards are symbols.

In an alternative embodiment, the player chooses a masked selection in the bonus game which hides a value. The revealed value corresponds to the number of chances the player has in the bonus round.

In the bonus round of the preferred embodiment of the present invention, the bonus game employs a random generation device, wherein the player randomly generates awards as well as a retry or a re-spin for use in the bonus game. Upon generating a retry or re-spin, the present invention preferably provides the player with the number of chances with which the player entered the bonus round. For example, if the player enters the bonus round with or has in the bonus round five spins of a wheel, and the player generates a retry or re-spin of the present invention on the fourth spin, the game provides the player with five extra spins in the bonus round. In an alternative embodiment, the game provides a number of free games as opposed to a number of retries or re-spins.

Further alternatively, the gaming device provides a number of retries based on the original number of spins. For instance, if the player hits on the fourth of five allotted spins, the gaming device may be adapted to provide the number used (four) or the number remaining (one).

It is therefore an advantage of the present invention to provide a gaming device having a bonus game which regenerates or provides a plurality of extra award-producing chances or opportunities upon the occurrence of a predetermined event.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
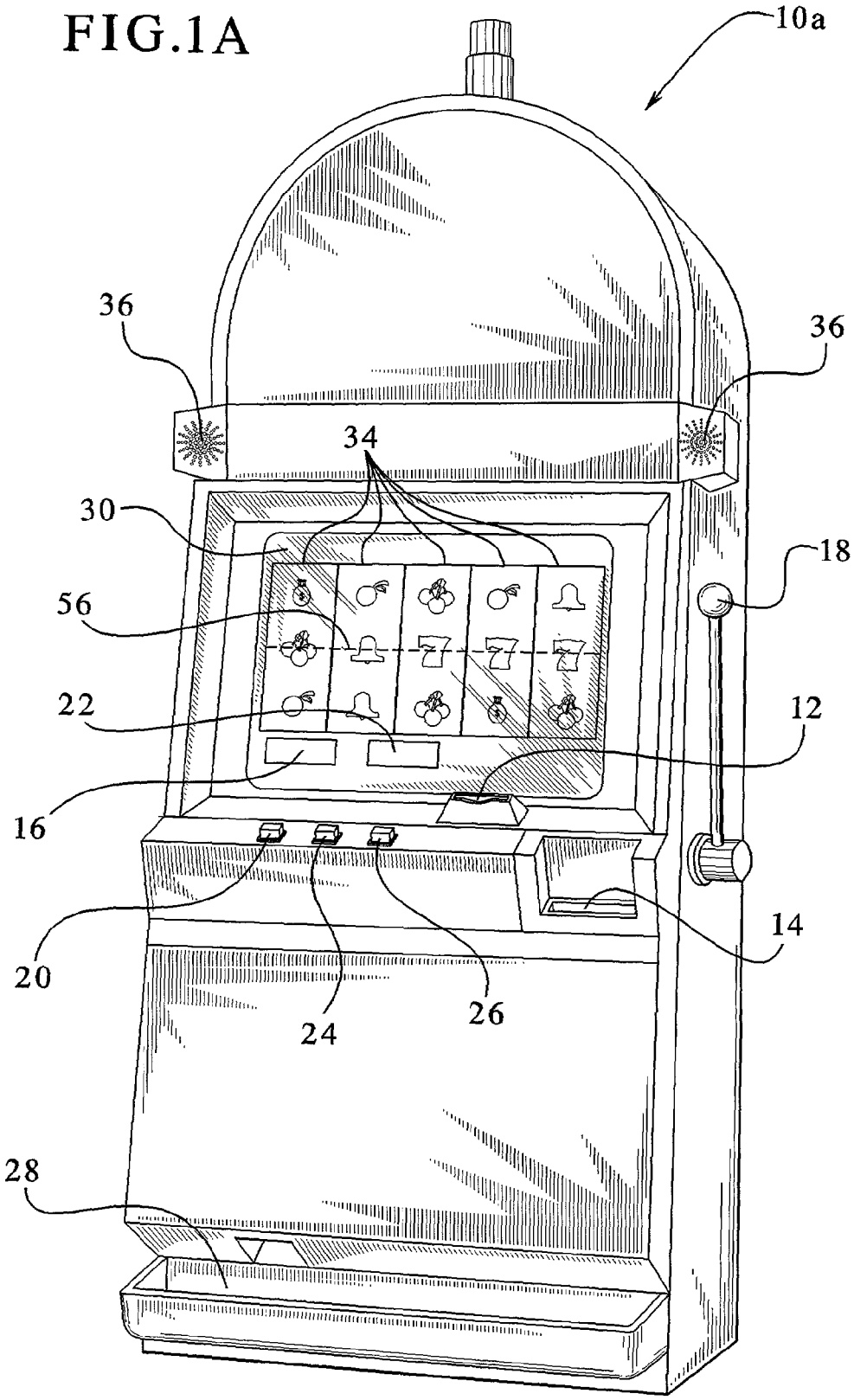
FIG. 1A is a front-side perspective view of one embodiment of the gaming device of the present invention.
Figure 1B:
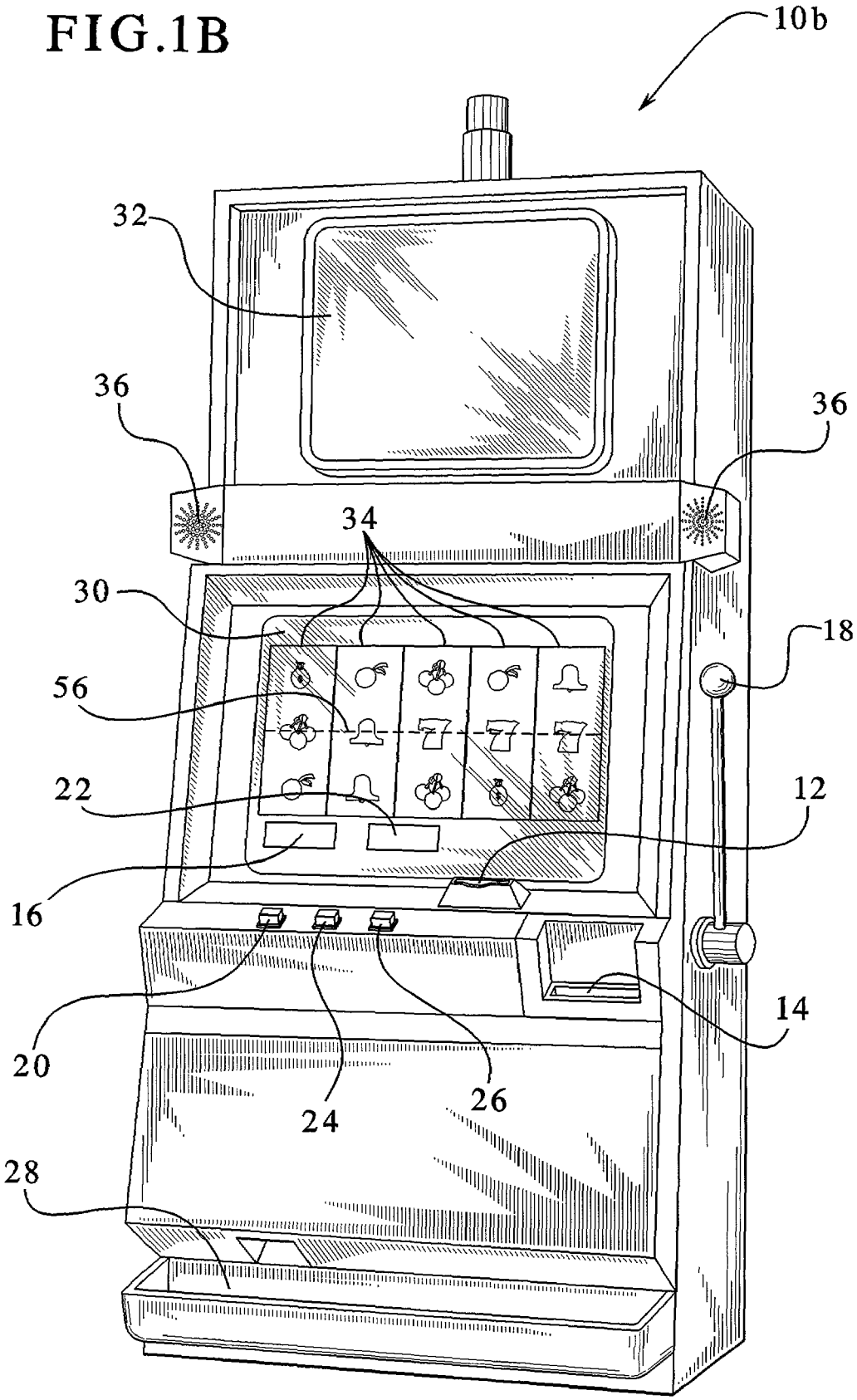
FIG. 1B is a front-side perspective view of another embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b*are generally referred to herein as gaming device 10. Gaming device 10 is preferably a slot machine having the controls, displays and features of a conventional slot machine. It is constructed so that a player can operate it while standing or sitting, and gaming device 10 is preferably mounted on a console. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or keno, any of their bonus triggering events and any of their bonus round games. The symbols and indicia used on and in gaming device 10 may be in mechanical, electrical or video form.

As illustrated in FIGS. 1A and 1B, gaming device 10 includes a coin slot 12 and bill acceptor 14 where the player inserts money, coins or tokens. The player can place coins in the coin slot 12 or paper money or a ticket voucher in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player, which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 in creases by one.

At any time during the game, a player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit vouchers redeemable by a cashier or electronically recordable cards, which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 preferably displays a plurality of reels 34, preferably three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other static or dynamic display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
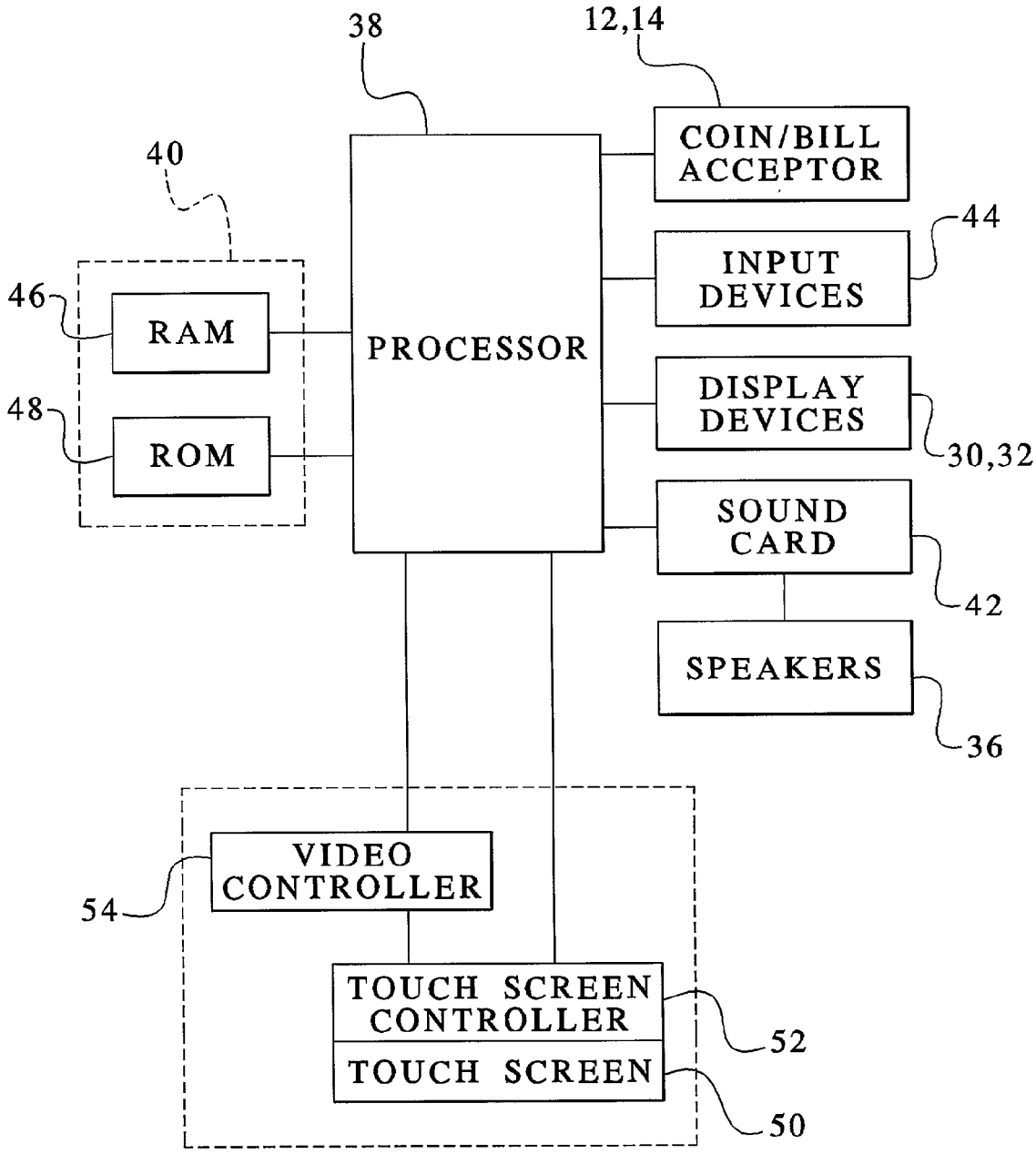
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the "computer" or the "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program that will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Operation of the Gaming Device

Figure 3:
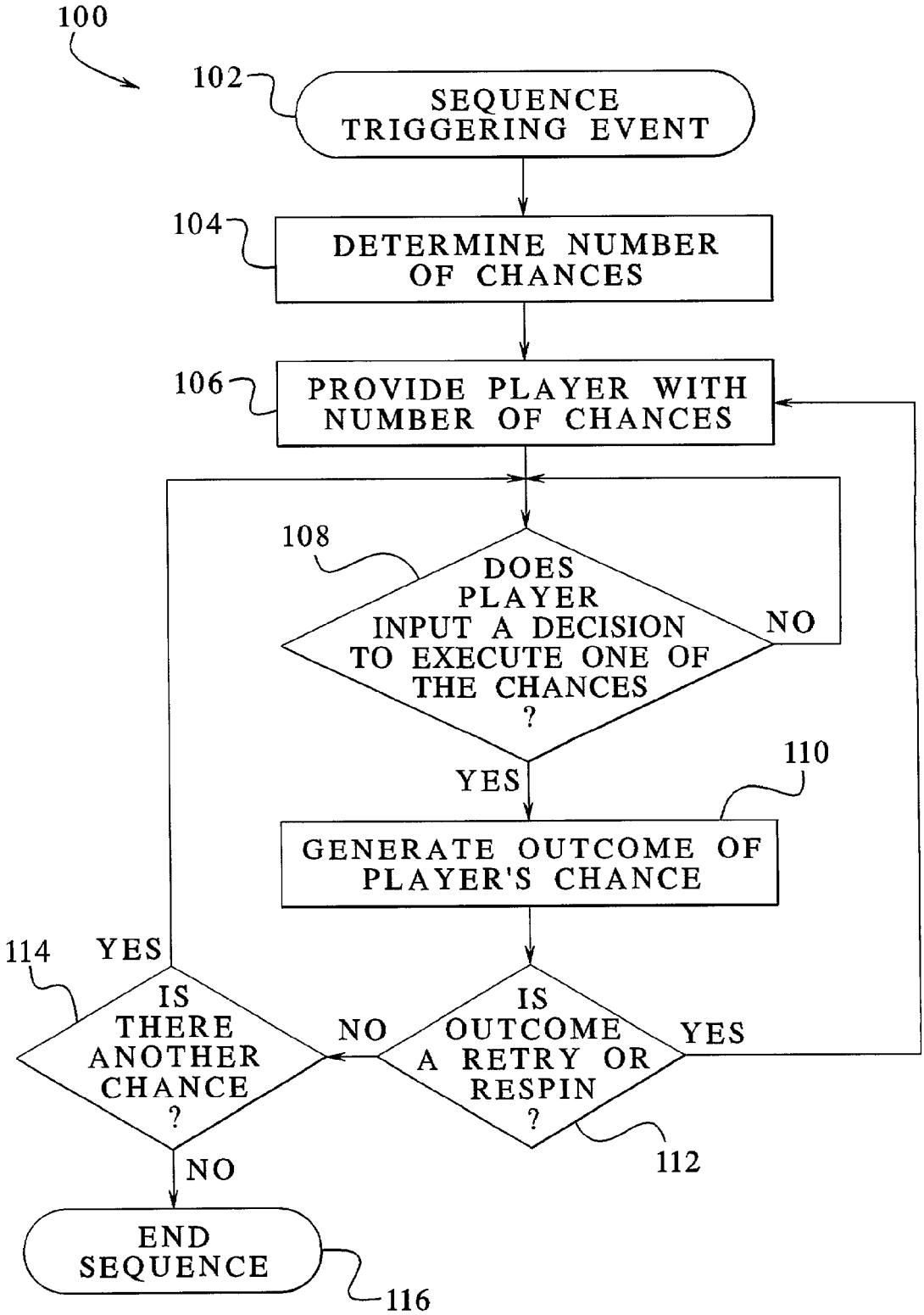
FIG. 3 is a flow diagram of one preferred embodiment of the method of the present invention, wherein the game provides a previously determined number of chances upon the generation of a retry.

Referring now to FIG. 3, a method 100 of one preferred embodiment of the present invention begins upon a sequence triggering event, as indicated by the oval 102. As described with respect to FIGS. 1A and 1B, the sequence triggering event, in a stand-alone embodiment, can be the deposit of an appropriate amount of money. The sequence triggering event, in a bonus game embodiment, can be a certain symbol or combination of symbols appearing on a payline 56 or in a scattered pay arrangement. A scatter pay arrangement usually requires a plurality of symbols anywhere on one of the display devices. That is, the game does not require the combination of symbols to appear along any given payline.

In other gaming devices, the bonus triggering event can be any event designated by the implementor such as a full house in a video poker gaming machine. After the occurrence of the sequence triggering event, the game determines a number of chances or opportunities that the player has at generating an award, as indicated by the block 104. The present invention contemplates the game predetermining the same number of chances each time a game begins. The present invention also contemplates the game predetermining or randomly determining a different number of chances each time a game begins.

More specifically, referring to FIGS. 1A and 1B, a game employing the present invention can predetermine the chances or opportunities that the player has at generating an award based upon the number of a certain symbol that appears on adjacent reels 34 along a payline 56. For example, the game can maintain a database (not illustrated) such that the game provides the player with three chances if the game randomly generates three adjacent "7" symbols, five chances if the game generates five adjacent "7" symbols and seven chances if the game generates five adjacent "7" symbols. The game can employ any chance or opportunity distribution.

In another embodiment, a game employing the present invention can maintain a database (not illustrated) such that the game randomly chooses one number from a range of possible numbers of chances. For example, the game can randomly choose between two to five chances if the game randomly generates three adjacent "7" symbols. The game can randomly choose between three to eight chances if the game generates four adjacent "7" symbols. The game can randomly choose between five to ten chances if the game generates five adjacent "7" symbols.

In a further embodiment, the game employing the present invention can maintain a database (not illustrated) such that the game randomly chooses one number from a weighted range of possible numbers of chances, such that the game selects at least one number more often than at least one other. For example, the game can randomly choose between two to five chances if the game randomly generates three adjacent "7" symbols, wherein there is a 20% chance of choosing a two, a 30% chance of choosing a three, a 30% chance of choosing a four and a 20% chance of choosing a five. The game can randomly choose between three to eight chances if the game generates five adjacent "7" symbols, wherein there is a 10% chance of choosing a three, four, seven and eight and a 30% chance of choosing a five and a six. The game can randomly choose between four to ten chances if the game generates five adjacent "7" symbols, wherein there is a 10% chance of choosing a four, five, six, nine and ten and a 25% chance of choosing a seven and an eight. Other symbols and probabilities can be implemented in accordance with the present invention.

Referring again to FIG. 3, after determining the number of chances, as indicated by the block 104, the game employing the present invention provides the player with the number of chances at generating an award, as indicated by block 106. The game then awaits an input from the player executing one of the chances, as indicated by the diamond 108. The present invention contemplates a game employing any random outcome generation device for executing one of the chances. The present invention includes employing one or more spinning wheels, one or more spinning reels, one or more playing cards, a light display, meter, scale or other type of random generation device.

If the player does not input a decision to execute one of the chances, the game re-enables the player to input such a decision and thereby creates a loop that continues until the player inputs the decision. The game can provide any suitable prompt (not illustrated), during the loop, urging the player to input a decision to execute one of the chances. If the player inputs a decision to execute one of the chances, as indicated by a positive response to the diamond 108, the game employing the present invention generates an outcome of the player's chance or opportunity, as indicated by the block 110. The present invention contemplates a game generating any outcome desired by the implementor including, but not limited to: no award; a retry or re-spin; an award of any value; an award in combination with a retry or re-spin; a number of free games; and a number of free games in combination with a number of re-spins and/or an award.

The game then determines whether the outcome or a component of the outcome includes a retry or re-spin, as indicated by the diamond 112. If the outcome or a component of the outcome does not include a retry or re-spin, the game determines whether another chance or opportunity exists, as indicated by the diamond 114. If another chance or opportunity exists, the game re-enables the player to input a decision to execute a chance or opportunity, as indicated by the diamond 108. If another chance or opportunity does not exist, the game sequence ends.

If the outcome or a component of the outcome includes a retry or re-spin, as indicated by a positive outcome of the diamond 112, the present invention provides the player with the previously determined number of chances or opportunities, as indicated by the block 106. Alternatively, the game may be adapted to provide the player with the previously determined number free games. The present invention thus enables the player to accumulate chances or opportunities. A game employing the present invention preferably does not end until the player exhausts all chances or opportunities, as indicated by diamond 114.

Figure 4:
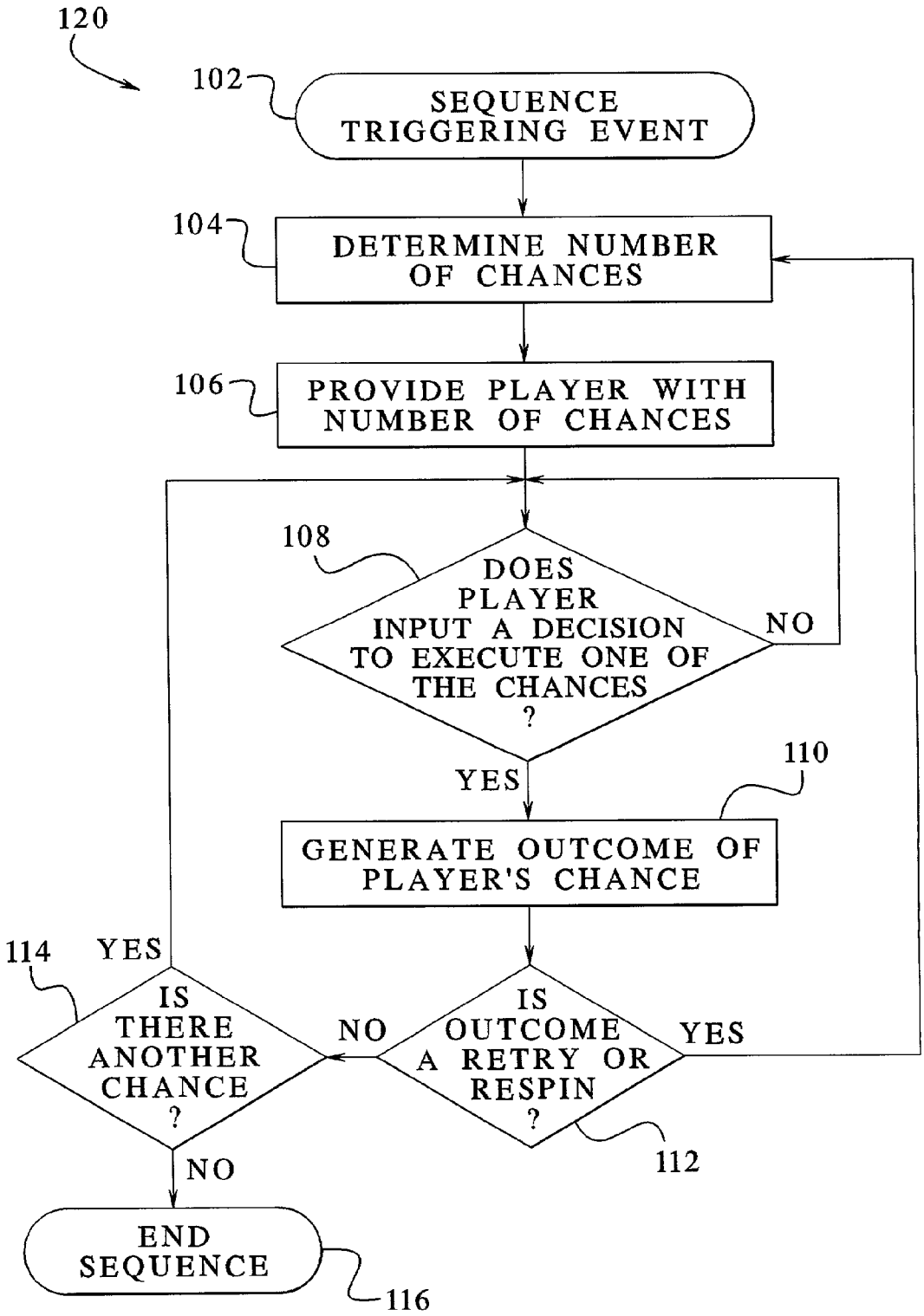
FIG. 4 is a flow diagram of one alternative embodiment of the method of the present invention, wherein the game re-determines a number of chances upon the generation of a retry.

Referring now to FIG. 4, a method 120 of an alternative embodiment of the present invention begins upon the occurrence of a sequence triggering event. The embodiment of FIG. 4 operates in the same manner as the embodiment of FIG. 3, except that in this alternative embodiment, the game re-determines the number of chances or opportunities that the player has at achieving an award after the game randomly generates a retry or re-spin. Or, the gaming device 10 redetermines a number of free games to provide to the player after the game runs.

In the preferred embodiment of FIG. 3, the game automatically awards the previously determined number. Here, if the outcome or a component of the outcome includes a retry or re-spin, the game determines a number of chances or opportunities that the player has at generating an award, as indicated by the block 104. This embodiment includes predetermining or randomly determining any number of chances after generating a retry or re-spin. This alternative embodiment also enables the player to accumulate chances or opportunities.

This embodiment further includes predetermining or randomly determining a number of chances or opportunities based on, e.g., less than, equal to or more than the number of chances initially determined. In one example, the game initially randomly determines and provides the player with five chances or opportunities and predetermines that the game provides the player with three additional chances each time the game generates a retry or re-spin. In another example, the game initially predetermines and provides the player with three chances or opportunities and randomly determines that the game provides the player with two to five additional chances each time the game generates a retry or re-spin. In a further example, gaming device 10 provides a number of additional chances equal to the number of attempts made or the number of attempts remaining.

Figure 5:
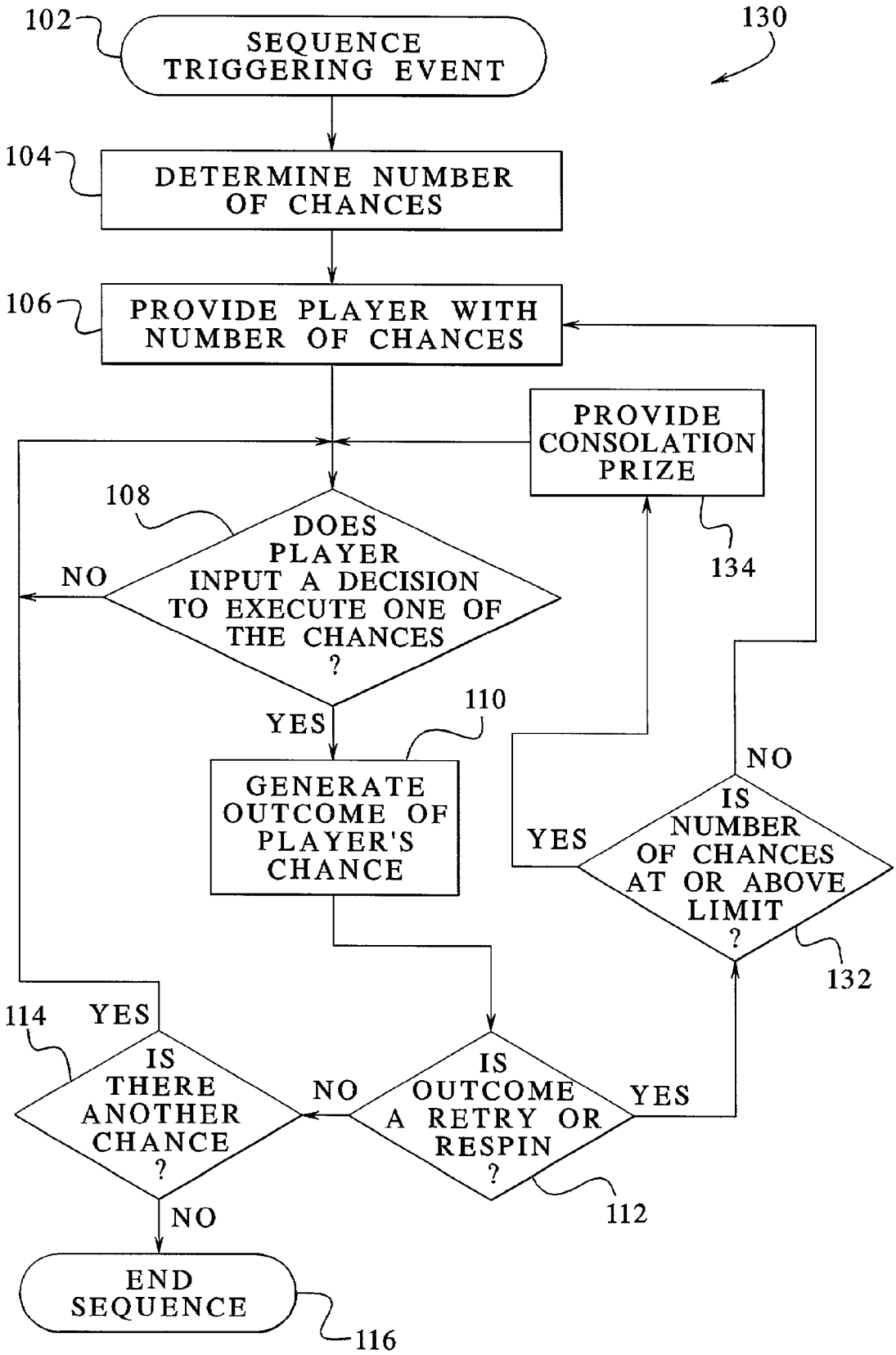
FIG. 5 is a flow diagram of another alternative embodiment of the method of the present invention, wherein the game places a limit on the number of chances that a player can accrue.

Referring now to FIG. 5, a method 130 of a further alternative embodiment of the present invention includes a limit on the number of chances that a player can accrue. The embodiment of FIG. 5 operates exactly the same as the embodiment of FIG. 3, except that in the further alternative embodiment of FIG. 5, the game places a governor or a limit on the total number of chances or attempts that the player can accrue. In the embodiments of FIGS. 3 and 4, the game enables the player to accrue any number of chances or opportunities. Here, if the outcome or a component of the outcome includes a retry or re-spin, the game determines whether the current number of chances or opportunities is at or above a predetermined limit, as indicated by the diamond 132. If the number of chances or opportunities is not at or above a predetermined limit, the game provides the player with a previously determined number of chances, as indicated by the block 106. This further alternative embodiment also contemplates re-determining a number of chances as described with respect to FIG. 4.

If the number of chances or opportunities is at or above a predetermined limit, the game preferably provides the player with a consolation prize in lieu of additional chances, as indicated by the block 134, and enables the player to continue executing award generating chances. The present invention alternatively does not have to provide a consolation prize.

In the further alternative embodiment, the present invention contemplates enabling the game to exceed the limit after one generation of a retry and thereafter not allowing the game to provide additional chances or opportunities. That is, if the player currently has nine chances or opportunities, the game has a ten chance or opportunity limit and the game automatically provides three additional chances upon the generation of a retry or re-spin, the present invention includes awarding the three chances upon a retry, bringing the player's total to twelve, and thereafter not allowing additional chances.

In the further alternative embodiment, the present invention contemplates not enabling the game to exceed the limit, even if the player obtains a retry or re-spin when the player's total number of chances is below a limit. That is, if the player currently has nine chances or opportunities, the game has a ten chance or opportunity limit and the game automatically provides three additional chances upon the generation of a retry or re-spin, the present invention includes awarding only one of three chances upon a retry, bringing the player's total to the limit of ten, and thereafter not allowing additional chances.

In the further alternative embodiment, the present invention contemplates not providing any additional chances when the determined number of chances would exceed the limit, even if the player obtains a retry or re-spin when the player's total number of chances is below a limit. That is, if the player currently has nine chances or opportunities, the game has a ten chance or opportunity limit and the game randomly generates two additional chances upon the generation of a retry or re-spin, the present invention includes awarding neither of the two chances, leaving the player with a total of nine. In the example, if the game randomly generates one additional chance upon the generation of a retry or re-spin, the game awards the chance, bringing the player's total to the limit of ten.

In the further alternative embodiment, the gaming device 10 in one implementation counts the number of re-spins that the player makes and applies the limit accordingly. That is, if the gaming device maintains a limit of ten, the player has already made six re-spins, has three remaining re-spins and generates two additional re-spins, the gaming device 10 can: (i) not award the two new re-spins; (ii) award one re-spin; or (iii) award both re-spins but provide no further re-spins.

Implementation

Figure 6:
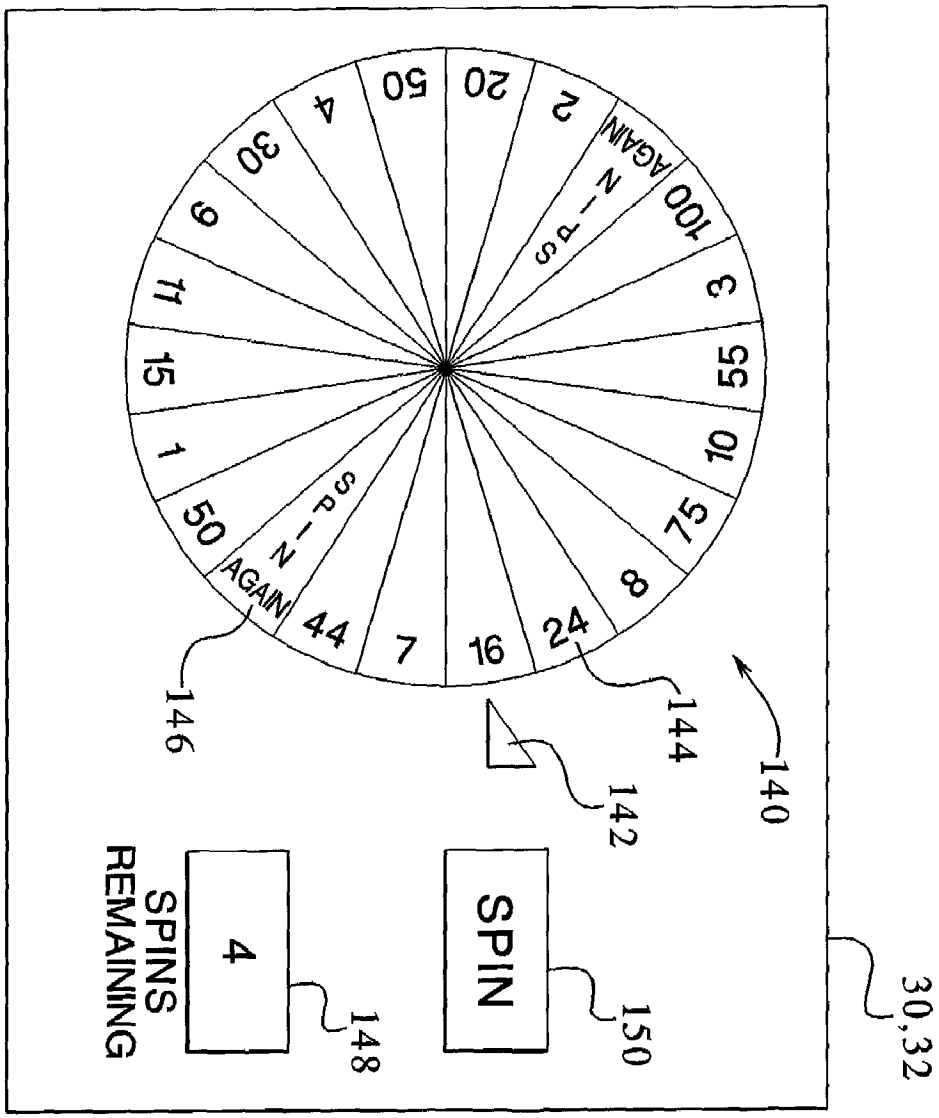
FIG. 6 an enlarged front plan view of a display device illustrating one preferred embodiment of the present invention.

Referring now to FIG. 6, one preferred embodiment of the present invention includes one of the display devices 30 or 32, displaying a rotatable wheel 140 having twenty-two equally sized pie-shaped sections. A cursor 142 designates one of the rotatable sections at all times. The present invention includes the wheel 140 and cursor 142 being electromechanical or simulated and preferably electromechanical. Twenty award sections 144 include an award. Two spin sections 146 include a retry or re-spin of the present invention. The preferred wheel embodiment is preferably employed in IGT's Wheel of Fortune game. It should be appreciated that the wheel embodiment, as well as other random generation devices, is applicable in many different games.

In the preferred embodiment, the game preferably maintains the same odds of generating a retry or re-spin, e.g., 11:1, regardless of the number of chances or opportunities currently held by the player. The game thus employs the same wheel at all times. If necessary, the chance limit or governor described above may be used to accomplish the desired game math and maintain profitability of the gaming device. It should be appreciated, however, that the gaming device may alternatively employ any odds of generating a retry or re-spin, wherein the odds vary or remain constant throughout the game. The spin sections alternatively include awards in addition to the retry function. The pie shape sections further alternatively include no symbols or ghost symbols, wherein the player receives no award or retry.

The wheel embodiment of the present invention preferably includes an electromechanical or simulated spins remaining meter or indicator 148. The game also preferably includes an electromechanical or simulated spins button or selector 150. A player thus inputs a decision to execute one of the remaining spins of the wheel as shown in the spins remaining indicator 148 by selecting the spin selector 150. The wheel 140 spins and stops, whereby the cursor 142 designates the award or retry of a randomly generated, adjacent pie shaped section.

It should be appreciated that the preferred embodiment of FIG. 6 illustrates one of many different random generation device that employ the retry or re-spin method of the present invention. The present invention includes one or more wheels having any number of pie-shaped sections, one or more reels having any number of stops or symbols, one or more cards, one or more dice, or any number of device embodying a random number generation.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is hereby claimed as follows:

1. A gaming device comprising:

a processor;

an initial indicator in a base game controlled by the processor for displaying a plurality of symbols;

an initial number of at least two award opportunities determined if at least one designated symbol or symbol combination is displayed by said initial indicator in a play of the base game, and the initial number of award opportunities being determined from a plurality of different possible numbers of award opportunities for different plays of the base game;

a bonus game caused by the processor to provide the determined initial number of award opportunities; and a secondary mechanical indicator in the bonus game controlled by the processor, the secondary mechanical indicator caused by the processor to: (a) display award outcomes resulting from the determined initial number of award opportunities; and (b) provide a player with a number of at least two additional award opportunities after at least one of the initial number of award opportunities is initiated, the number of additional award opportunities being directly based on the determined initial number of award opportunities in said play of the base game.

2. The gaming device of claim 1, wherein the number of additional award opportunities is equal to said initial number of award opportunities.

3. The gaming device of claim 1, wherein the initial number of award opportunities is randomly determined.

4. The gaming device of claim 1, wherein the number of additional award opportunities is predetermined based on the symbol or symbol combination displayed by the initial indicator.

5. The gaming device of claim 1, wherein said initial indicator includes a plurality of reels having a plurality of symbols.

6. The gaming device of claim 1, wherein said secondary mechanical indicator includes a wheel having a plurality of sections.

7. The gaming device of claim 1, wherein the secondary mechanical indicator includes a plurality of re-spin sections, at least two of said re-spin sections providing a different number of additional award opportunities.

8. The gaming device of claim 1, which includes means controlled by said processor for indicating the number of award opportunities and additional award opportunities to a player.

9. The gaming device of claim 1, which includes a limit to accumulated award opportunities and additional award opportunities.

10. The gaming device of claim 9, which includes a consolation award provided to a player upon reaching said limit.

11. The gaming device of claim 1, wherein the player is provided additional award opportunities upon an occurrence of an award opportunity outcome.

12. The gaming device of claim 11, wherein the number of additional award opportunities is based on the initial number of award opportunities which have not been used before the generation of the award opportunity outcome.

13. The gaming device of claim 11, wherein the number of additional award opportunities is based on the initial number of award opportunities which have been used before the generation of the award opportunity outcome.

14. A gaming device comprising:

a processor for providing on a first display to a player, an initial number of at least two award opportunities in a play of a base game, said initial number of award opportunities being determined from a plurality of different possible numbers of award opportunities upon generation of an award opportunity outcome in a play of the base game;

a bonus game caused by the processor to provide the determined initial number of award opportunities; and a secondary mechanical indicator in the bonus game, the secondary mechanical indicator caused by the processor to: (a) display at least one award outcome resulting from the determined initial number of award opportunities; and (b) provide a number of at least two additional award opportunities after at least one of the initial number of award opportunities is initiated, the number of additional award opportunities being directly based on the determined initial number of award opportunities in said play of the base game.

15. The gaming device of claim 14, wherein said number of additional award opportunities is equal to the initial number of award opportunities.

16. The gaming device of claim 14, wherein the first display includes a plurality of symbols, wherein at least one symbol or symbol combination generates the initial number of award opportunities.

17. The gaming device of claim 16, wherein the first display includes a plurality of reels having a plurality of symbols.

18. The gaming device of claim 16, wherein said secondary mechanical indicator includes a wheel having a plurality of sections.

19. The gaming device of claim 14, which includes means controlled by the processor for indicating the initial number of award opportunities to said player.

20. The gaming device of claim 14, which includes means controlled by the processor for a player to initiate an outcome indicated by the secondary mechanical indicator.

21. The gaming device of claim 14, which includes a limit to an accumulated number of award opportunities and additional award opportunities.

22. The gaming device of claim 21, which includes a consolation award provided to the player upon reaching the limit.

23. A gaming device comprising:

a processor for providing a number of at least two additional award opportunities in a play of a bonus game upon generation of an opportunity outcome in the bonus game, the number of additional award opportunities being based on an initial number of at least two award opportunities determined in a base game, the initial number of award opportunities being determined from a plurality of different possible numbers of award opportunities available in a play of the base game;

a first indicator controlled by the processor for displaying a plurality of symbols in the base game, the processor causing at least one symbol or symbol combination in a play of said base game to generate the initial number of award opportunities in the base game; and a second indicator controlled by the processor for displaying at least one award outcome and at least one award opportunity outcome in the bonus game, the processor causing the second indicator to: (a) display at least one award outcome resulting from the determined initial number of award opportunities; and (b) indicate the number of additional award opportunities after at least one of the initial number of award opportunities is initiated.

24. A gaming device comprising:

a processor;

an initial indicator including a plurality of reels in a base slot game controlled by the processor for displaying of a plurality of symbols;

at least two initial award opportunities associated with at least one symbol or symbol combination of the initial indicator in a play of the game, the initial number of award opportunities being determined from a plurality of different possible numbers of award opportunities for different plays of the game;

a bonus game caused by the processor to provide the determined initial number of award opportunities;

a secondary mechanical indicator in the bonus game controlled by the processor, said secondary mechanical indicator including a wheel having a plurality of sections for displaying award outcomes resulting from the determined initial number of award opportunities, the bonus game providing at least one award opportunity outcome, the award opportunity outcome providing a player with a plurality of additional award opportunities equal to said initial number of award opportunities in said play of the base game; and means controlled by said processor for indicating the number of award opportunities, additional award opportunities, and a limit to accumulated award opportunities and additional award opportunities provided to the player.

25. A method for operating a gaming device, the method comprising the steps of:

(a) enabling a player to play a first game;

(b) providing an initial number of at least two award opportunities for a second game to the player during play of said first game wherein the initial number of award opportunities is determined from a plurality of different possible numbers of award opportunities for different plays of the first game upon generation of an award opportunity outcome in a play of the first game;

(c) enabling the player to play the second game wherein: (i) the second game provides the determined initial number of award opportunities; and (ii) the second game displays at least one award opportunity outcome resulting from the determined initial number of award opportunities; and (d) providing to the player a number of at least two additional award opportunities based on the initial number of award opportunities in said play of the base game upon the generation of the award opportunity outcome during the second game.

26. The method of claim 25, wherein playing said second game includes rotating a wheel or a cursor.

27. The method of claim 25, wherein playing said second game includes generating an accompanying award.

28. The method of claim 25, wherein providing additional award opportunities includes providing a predetermined number of additional award opportunities.

29. The method of claim 25, wherein providing additional award opportunities includes providing a number of additional award opportunities equal to the initial number of award opportunities.

30. A method for operating a gaming device, the method comprising the steps of:

(a) enabling a player to play a base game;

(b) providing an initial number of at least two award opportunities for a bonus game to said player during play of the base game wherein the initial number of award opportunities for said bonus game is determined from a plurality of different possible numbers of award opportunities for different plays of the bonus game upon the generation of an award opportunity outcome in a play of the base game;

(c) enabling the player to play said bonus game wherein: (i) the bonus game provides the determined initial number of award opportunities; and (ii) the second game displays at least one award opportunity outcome resulting from the determined initial number of award opportunities; and (d) providing a number of at least two additional award opportunities equal to the initial number of award opportunities to the player upon generation of the award opportunity outcome during the bonus game.

31. A method for operating a gaming device, the method comprising the steps of:

(a) displaying a plurality of symbols in a play of a first game;

(b) determining an initial number of at least two award opportunities in said play of the first game wherein the initial number of award opportunities is: (i) determined from a plurality of different possible numbers of award opportunities; and (ii) is designated for a play of a second game upon generation of an award opportunity outcome in the first game;

(c) providing the determined initial number of award opportunities in the play of the second game;

(d) displaying at least one award opportunity outcome resulting from the determined initial number of award opportunities; and (e) providing a number of at least two additional award opportunities upon generation of said award opportunity outcome, said number of additional award opportunities being based on the determined initial number of award opportunities in the play of the first game.

32. The method of claim 31, wherein the symbols are identical.

33. The method of claim 31, wherein the symbols are adjacent to one another along a payline.

34. The method of claim 31, wherein the number of additional award opportunities provided to the player is equal to the number of predetermined symbols displayed.

35. The method of claim 31, which includes selecting the number of additional award opportunities from a plurality of numbers of additional award opportunities associated with each number of predetermined symbols displayed.

36. The method of claim 35, which includes associating a probability with each of said plurality of numbers of additional award opportunities wherein the likelihood of a number of additional award opportunities being selected is based on the number of predetermined symbols displayed.

37. The method of claim 35, wherein the number of additional award opportunities associated with at least one of the numbers of predetermined symbols displayed is different from at least one of the numbers of additional award opportunities associated with another number of predetermined symbols.

38. A gaming device comprising:

a first game and a second game;

a processor controlling the first game and the second game;

an initial number of at least two award opportunities for a second game determined for the player during play of said first game based on an award opportunity outcome generated in said first game, the initial number of award opportunities being determined from a plurality of different possible numbers of award opportunities for different plays of the first game or the second game, the processor causing the second game to:

(a) display award opportunity outcomes resulting from the determined initial number of award opportunities; and (b) provide a number of at least two additional award opportunities based on said initial number of award opportunities, said additional award opportunities being provided to the player upon the generation of at least one of the award opportunity outcomes during the second game.

39. A gaming device comprising:

a first game and a second game;

a processor controlling the first game and the second game;

an indicator for displaying a plurality of symbols;

an initial number of at least two award opportunities, the initial number of award opportunities being determined from a plurality of different possible numbers of award opportunities upon the generation of an award opportunity outcome upon a play of the first game, the determined initial number of award opportunities being provided in a play of the second game,the processor causing:

(a) said initial number of award opportunities provided in the second game to result in at least one award outcome in said second game; and (b) the second game to provide a number of at least two additional award opportunities, the number of additional award opportunities being based on the initial number of award opportunities determined in the first game; and at least one predetermined symbol displayed by the indicator in said play of the first game.

40. The gaming device of claim 39, wherein the number of additional award opportunities provided to the player is based on the number of predetermined symbols displayed by the indicator.

41. The gaming device of claim 39, wherein the predetermined symbols are identical.

42. The gaming device of claim 39, wherein the predetermined symbols are adjacent to one another along a payline.

43. The gaming device of claim 39, wherein the number of additional award opportunities is equal to the number of predetermined symbols displayed by the indicator.

44. The gaming device of claim 39, wherein the number of additional award opportunities is selected from a plurality of numbers of additional award opportunities associated with each number of predetermined symbols displayed by the indicator.

45. The gaming device of claim 44, wherein a probability is associated with each of said plurality of numbers of additional award opportunities, wherein the likelihood of a number of additional award opportunities being selected is based on the number of predetermined symbols displayed by the indicator.

46. The gaming device of claim 44, wherein at least one of the numbers of additional award opportunities of said plurality of numbers of additional award opportunities associated with the number of predetermined symbols displayed by the indicator is different from at least one of the plurality of numbers of additional award opportunities associated with another number of predetermined symbols.

47. A gaming device comprising:

a processor;

an initial indicator in a base game controlled by the processor for displaying a plurality of symbols;

an initial number of at least two award opportunities determined if at least one designated symbol or symbol combination is displayed by said initial indicator in a play of the base game, the initial number of award opportunities being determined from a plurality of different possible numbers of award opportunities for different plays of the game; and a bonus game caused by the processor to provide the determined initial number of award opportunities;

a secondary mechanical indicator in the bonus game caused by the processor to: (a) display award outcomes resulting from the determined initial number of award opportunities; and (b) provide the player with a number of at least two additional award opportunities after at least one of the initial number of award opportunities is initiated, the number of additional award opportunities being based on the determined initial number of award opportunities in the play of the base game.

48. The gaming device of claim 47, wherein the symbols are identical.

49. The gaming device of claim 47, wherein the symbols are adjacent to one another along a payline.

50. The gaming device of claim 47, wherein the number of additional award opportunities is equal to the number of predetermined symbols displayed by the secondary mechanical indicator.

51. The gaming device of claim 47, wherein the number of additional award opportunities is selected from a plurality of numbers of additional award opportunities associated with each number of predetermined symbols displayed by the secondary mechanical indicator.

52. The gaming device of claim 51, wherein a probability is associated with each of said plurality of numbers of additional award opportunities wherein the likelihood of a number of additional award opportunities being selected is based on the number of predetermined symbols displayed by the secondary mechanical indicator.

53. The gaming device of claim 51, wherein at least one of the numbers of additional award opportunities of said plurality of numbers of additional award opportunities associated with the number of predetermined symbols displayed by the secondary mechanical indicator is different from at least one of the plurality of numbers of additional award opportunities associated with another number of predetermined symbols.

54. A gaming device comprising:

a processor;

an indicator for displaying a plurality of symbols;

an initial number of at least two award opportunities in a play of a first game, the initial number of award opportunities being determined from a plurality of different possible numbers of award opportunities for different plays of a first game; and a second game caused by the processor to: (a) provide the determined initial number of award opportunities; (b) display at least one award outcome resulting from the determined initial number of award opportunities; and (c) provide a number of at least two additional award opportunities after at least one of the initial number of award opportunities is initiated, the number of additional award opportunities being based on the number of initial award opportunities determined in the first game.

55. A gaming device comprising:

a processor;

an indicator for displaying a plurality of symbols;

an initial number of at least two award opportunities determined from a plurality of different possible numbers of award opportunities for different plays of a first game upon generation of an award opportunity outcome in the first game;

a second game caused by the processor to: (a) provide the determined initial number of award opportunities; (b) display at least one award opportunity outcome resulting from the determined initial number of award opportunities; and (c) provide a number of at least two additional award opportunities after at least one of the initial number of award opportunities is initiated, the number of additional award opportunities provided to the player being based on the number of initial award opportunities which have been determined in the first game before the display of the award opportunity outcome in the second game.

56. A gaming device comprising:

a first game and a second game;

a processor controlling the first game and the second game;

a number of first game award opportunities provided to the player during the first game, the number of first game award opportunities being at least two and being determined from a plurality of different possible numbers of award opportunities;

a first game award opportunity outcome provided by the processor;

a number of second game award opportunities provided to the player during the second game; and a second game award opportunity outcome resulting from the determined number of first game award opportunities, said number of second game award opportunities being at least two and being provided to the player upon the generation of said second game award opportunity outcome after at least one of the first game award opportunities is initiated, the number of second play award opportunities being based on the number of the first play award opportunities determined in the first game.

* * * * *

UNITED STATES PATENT AND TRADEMARK OFFICE

CERTIFICATE OF CORRECTION

PATENT NO. : 7,066,814 B2
APPLICATION NO. : 09/960784
DATED : June 27, 2006
INVENTOR(S) : Paulina Glavich et al.

It is certified that error appears in the above-identified patent and that said Letters Patent is hereby corrected as shown below:

IN THE CLAIMS

In Claim 17, column 11, line 45, change “claim 16” to --claim 14--.

In Claim 18, column 11, line 48, change “claim 16” to --claim 14--.

Signed and Sealed this

Tenth Day of October, 2006

JON W. DUDAS
*Director of the United States Patent and Trademark Office*